US006375209B1

(12) United States Patent
Schlangen

(10) Patent No.: US 6,375,209 B1
(45) Date of Patent: Apr. 23, 2002

(54) POWERED WHEELCHAIR

(75) Inventor: Phillip E. Schlangen, Minneapolis, MN (US)

(73) Assignee: Kurt Manufacturing Company, Minneapolis, MN (US)

( * ) Notice: Subject to any disclaimer, the term of this patent is extended or adjusted under 35 U.S.C. 154(b) by 0 days.

(21) Appl. No.: 09/167,051

(22) Filed: Oct. 6, 1998

Related U.S. Application Data

(60) Provisional application No. 60/061,140, filed on Oct. 6, 1997.

(51) Int. Cl.[7] ..... A47C 4/12; A61G 5/00

(52) U.S. Cl. ..... 280/250.1; 280/304.1; 180/907

(58) Field of Search ..... 280/647, 649, 280/250.1, 304.1, 47.41, 47.38, 657; 180/907, 65.1; 297/411.36, 411.38, 423.32

(56) References Cited

U.S. PATENT DOCUMENTS

| | | | | |
|---|---|---|---|---|
| 2,586,273 A | | 2/1952 | Steven | |
| 2,993,550 A | | 7/1961 | Klappert | |
| 3,100,547 A | | 8/1963 | Rosenthal | |
| 3,213,957 A | | 10/1965 | Wrigley | |
| 3,282,605 A | * | 11/1966 | Nihlean et al. | 297/423.32 |
| 3,749,192 A | | 7/1973 | Karchak, Jr. et al. | |
| 3,807,520 A | | 4/1974 | Chisholm | |
| 4,037,676 A | | 7/1977 | Ruse | |
| 4,101,143 A | * | 7/1978 | Sieber | 280/647 |
| 4,199,036 A | * | 4/1980 | Wereb | 180/65.1 |
| 4,515,383 A | | 5/1985 | Minnebrakker | 280/242 |
| 4,805,711 A | | 2/1989 | Lautzenhiser | |
| 4,949,408 A | | 8/1990 | Trkla | |
| D316,063 S | | 4/1991 | Michel | D12/131 |
| 5,094,310 A | | 3/1992 | Richey et al. | |
| 5,145,197 A | * | 9/1992 | Gatti | 280/304.1 |
| 5,156,226 A | | 10/1992 | Boyer et al. | 180/65.1 |
| 5,217,239 A | * | 6/1993 | Koet | 280/250.1 |
| 5,242,138 A | | 9/1993 | Kornberg | 248/118 |
| 5,351,774 A | | 10/1994 | Okamoto | |
| 5,372,405 A | * | 12/1994 | Cash et al. | 297/411.36 |
| 5,435,404 A | * | 7/1995 | Garin, III | 180/65.1 |
| 5,480,172 A | * | 1/1996 | James | 280/250.1 |
| 5,531,284 A | | 7/1996 | Okamoto | |
| 5,540,297 A | | 7/1996 | Meier | |
| 5,575,348 A | | 11/1996 | Goertzen et al. | |
| 5,964,473 A | * | 10/1999 | Degonda et al. | 280/250.1 |

* cited by examiner

*Primary Examiner*—Lanna Mai
*Assistant Examiner*—Hau Phan

(57) ABSTRACT

A wheelchair has a seat assembly with arm rests locked in upright positions and movable to down positions provide lateral access to seat for a person. Electric motors connected to batteries and a motor controller are used to rotate the drive wheels of the wheelchair. Hooks, pulleys, and power transmissions transmit power from the electric motors to the wheels. The entire components of the drive are located within a casing mounted on the frame of the wheelchair.

15 Claims, 15 Drawing Sheets

POWERED WHEELCHAIR

CROSS REFERENCE TO RELATED APPLICATION

This application claims benefit of U.S. Provisional patent application Ser. No. 60/061,140, filed Oct. 6, 1997.

FIELD OF THE INVENTION

The present invention relates to the art of wheelchair and, more particularly to motor wheelchairs.

BACKGROUND OF THE INVENTION

Wheelchairs powered with reversible electric motors are used to provide motorized mobility to persons. Examples of powered wheelchairs are disclosed by G. G. Goertzen, N. J. Curran and J. H. Molnar in U.S. Pat. No. 5,575,348 and J. B. Richey, T. D. Wakefield and A. D. Wainscott in U.S. Pat. No. 5,094,310. These wheelchairs have frames supported on wheels for rolling movement. Electric motors coupled to batteries drive speed reducing gear boxes which transmit torque to the drive wheels of the wheelchair to move the wheelchair. The efficiency of the power of the motors transmitted to the drive wheels in reduced by the power required to operate the speed reducing gear boxes. Seat units having side arm rests are mounted on the frames to accommodate persons in need to the use of wheelchairs. The seat units have open fronts providing access to the seat and back rests. The arm rests prevent lateral admittance of the persons to the seat units. Electronic control units carried by the wheelchair regulate power driven operation of the drive motors. Joy sticks located adjacent the arm rests are used by persons seated in the seat units to actuate the control units which control the operation of the motors to move the steer the wheelchair. The electric motors, speed reducing gear boxes, electronic control units and battery re-chargers are located below the level of the seat units and are exposed to environmental elements, such as dirt, mud, water, ice and snow.

SUMMARY OF THE INVENTION

The invention comprises a wheelchair having a novel seat assembly, enclosed electric motor drives, and foot rests. The wheelchair has a frame with side frame members rotatably supporting drive shafts for wheels driven by the electric motor drives to move the wheelchair. A casing mount on the side frame members encloses the electric motors, motor drives to shield the motors and drives from the external environment including water, dirt, mud, ice, and snow. The batteries and electronic control unit connected to the motors are also located within the casing. The motor drives have power transmission systems located within the casing that efficiently transfers power from the electric motors to the drive wheels.

The seat assembly has a base and side members hinged to the base for selective movement to upright and down positions. Arm rest are mounted on the side members. Releaseable locks hold the members in the upright members. When the locks are released the side members and arm rests can be pivoted to down positions to allow lateral access to the seat of the seat assembly. A person can be admitted to the seat assembly from the front or either side of the seat assembly. The front of the base of the seat rest in pivotally mounted on the frame to allow the base to pivot about a transverse horizontal axis. Shock absorbers having coil springs connected to the rear of the base and frame cushion the seat assembly. The shock absorbers extend downwardly and rearwardly from the base to provide non-linear compression forces the absorb impact and bounce movements of the person in the seat assembly. This reduces stresses and strains on the person's back.

A pair of foot rests secured to the frame extend downwardly from the front of the seat assembly to accommodate the legs and feet of the person seated in the seat assembly. Each foot rest has first and second square tubular members with the second member telescoped in the first member. Fasteners hold the members together in a selected position to adjust the length of the foot rest to fit the person in the seat assembly. A platform pivotally mounted on the lower end of the second member is retained in a generally horizontal or slightly inclined position to support a persons foot. The platform can be folded up against the members so that it does not interfere with the front seating of the person in the seat assembly.

DESCRIPTION OF PREFERRED EMBODIMENTS

Figure 1:
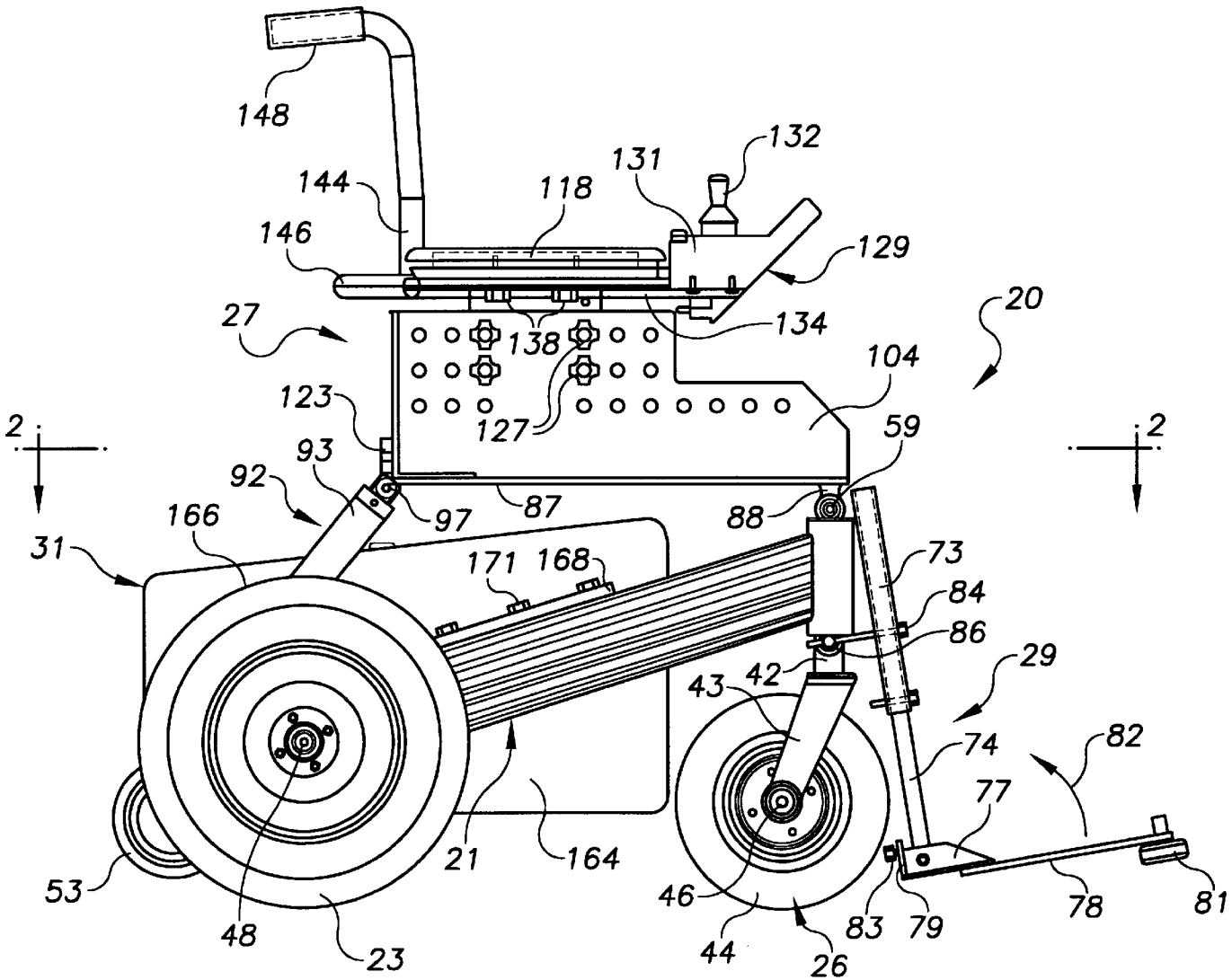
FIG. 1 is a side elevational view of the POWERED WHEELCHAIR of the invention.
Figure 2:
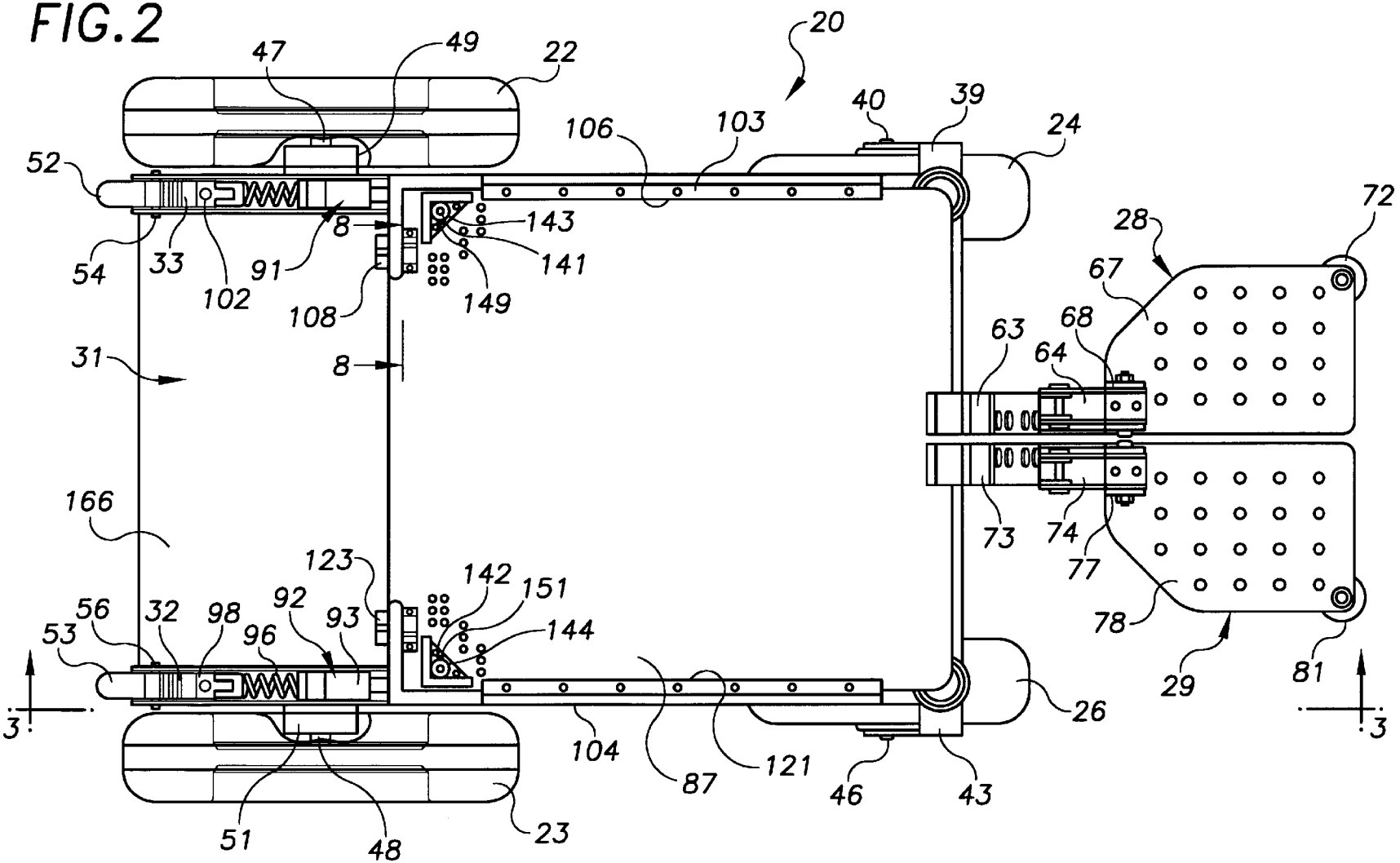
FIG. 2 is a sectional view taken along line 2—2 of FIG. 1.

Referring to FIGS. 1 and 2, powered wheelchair, indicated generally at 20, has a frame 21 movable supported on a surface with rear drive wheels 22 and 23 and front caster wheels 24 and 26. A seat assembly 27 mounted on top of frame 21 is adapted to accommodate a person to allow the person to operate the controls of the wheelchair. A pair of foot rests 28 and 29 mounted on the front of frame 21 extends downwardly from the front of seat assembly 27 to support a person's legs and feet. A casing 31 shown as a box shaped housing mounted on frame 21 encloses the drive motors and belts and pulleys that connect the motors to drive wheels 22 and 23. The batteries, battery charger and motor controls are also located within casing 31. Casing 31 insulates all of the drive components and electric power supply from the external environment, including dust, dirt, water, snow and ice.

Frame 21 has side frame members 32 and 33 having front ends secured to upright tubular members or sleeves 34 and 36. A horizontal cross beam 37 extends between sleeves 34 and 36. The ends of beam 37 are secured to sleeves 34 and 36. Frame members 32 and 33 are rigid metal tubular extrusions inclined downwardly and rearwardly from sleeves 34 and 36 adjacent opposite sides of casing 31.

Caster wheels 24 and 26 are mounted on sleeves 34 and 36 for swinging movement about upright axes to steer wheelchair 20. Caster wheel 24 has an upright post 38 rotatable mounted with bearings within sleeve 34. A yoke 39 straddling the tire 41 is secured to post 38 and axle 40 of the wheel. Caster wheel 26 has an upright post 42 rotatably mounted with bearings within sleeve 36. The lower end of post 42 is secured to a yoke 43 which straddles tire 44. The lower ends of yoke 43 are attached to a horizontal axle 46 of the wheel. Caster wheels 24 and 26 turn about the horizontal axles of the wheels and swing about the upright axes of sleeves 34 and 36 during movement of wheelchair 20.

Figure 3:
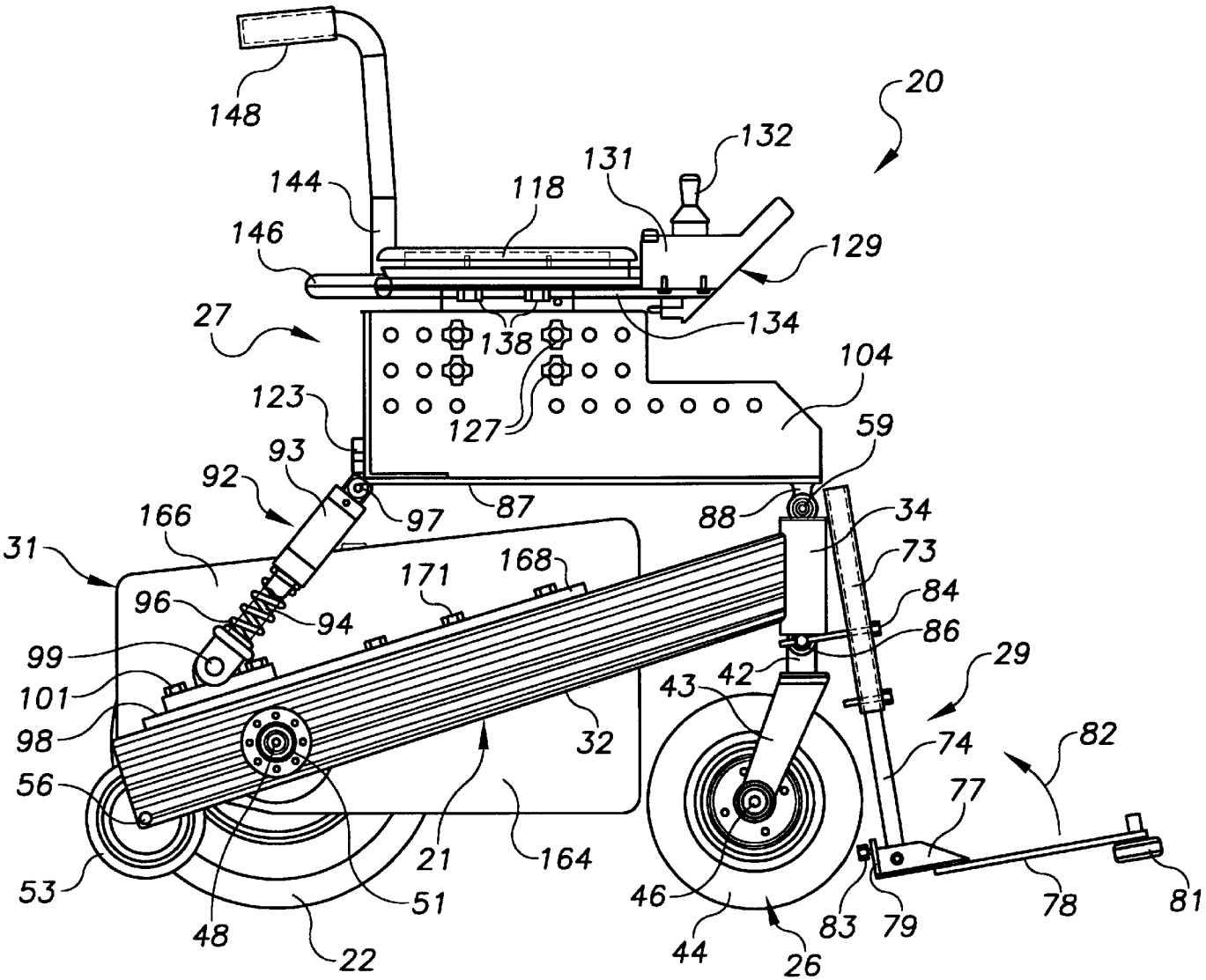
FIG. 3 is a sectional view taken along line 3—3 of FIG. 2.

As shown in FIG. 2, drive wheels 22 and 23 are mounted on drive shafts 47 and 48 extended outwardly from bearings 49 and 51 secured to side frame members 32 and 33. Anti-tip wheels 52 and 53 are rotatable mounted on axles 54 and 56 retained on the lower rear ends of side frame members 32 and 33. As seen in FIGS. 1 and 3, anti-tip wheels 52 and 53 are rearwardly of axles 47 and 48 and above the bottom of wheels 22 and 23. The wheels 52 and 53 prevent wheelchair 20 from tipping backward upon initial forward acceleration.

Figure 4:
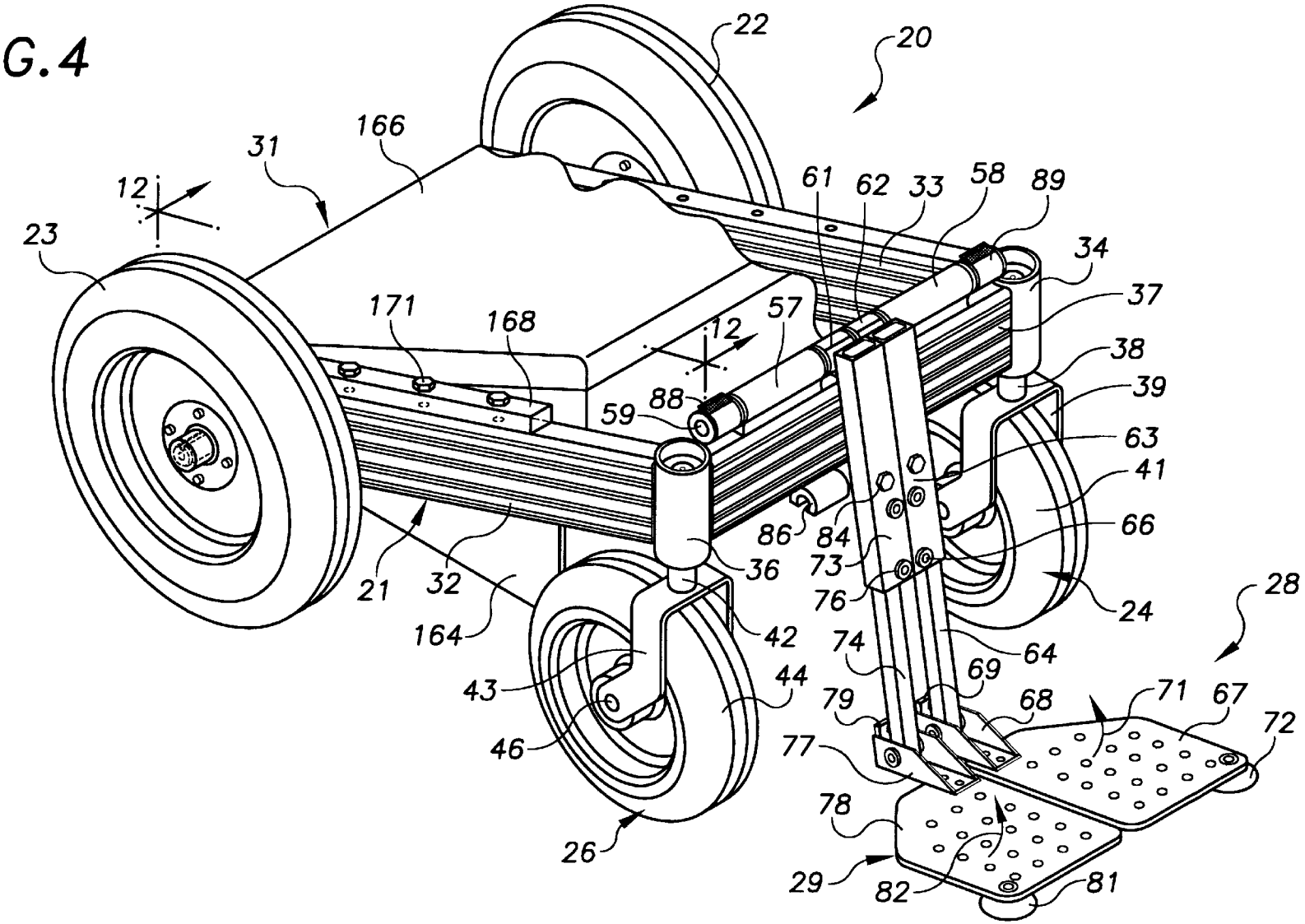
FIG. 4 is a perspective view of the wheelchair with the seat assembly removed from the frame.

As shown in FIG. 4, a pair of horizontal tubular members 57 and 58 connected to the top of cross beam 37 accommodates a transverse rod 59. A pair of blocks 61 and 62 rotatable mounted on rod 59 between members 57 and 58 connect foot rests 28 and 29 to rod 59 for pivot movement about a transverse horizontal axis. Foot rest 28 has a first square tube 63 attached to block 62. A second square tube 64 telescopes into the lower end of tube 62. A pair of bolts 66 clamps tube 64 onto tube 63 to fix the over all combined length of tubes 63 and 64. Bolts 66 can be released to allow tube 64 to be vertically adjusted to meet the requirements of the person using wheelchair 20.

A platform 67 is hinged with a bracket 68 to the lower end of tube 64. Bracket 68 has a stop 69 engageable with tube 64 to hold platform 67 in a forward generally horizontal position and allow platform 67 to be moved up against tube 64 as shown by arrow 71. A bumper roller 72 is rotatably mounted on the outer front corner of platform 76. Roller 72 rides on doors to allow wheelchair 20 to push the doors open. Foot rest 29 has the same structure and function as foot rest 28 for the right leg and foot of the person using the wheelchair. Foot rest 29 has first and second square tubes 73 and 74 clamped together with bolts 76. The upper end of tube 73 is secured to block 61. Tube 74 telescopes into the lower end of tube 73. A bracket 77 hinged to tube 74 is attached to a platform 78 which provides a rest for a person's foot. Bracket 77 has a stop 79 engageable with tube 74 to hold platform 78 in a generally horizontal position and allow platform 78 to be moved up against tube 74 as shown by arrow 82. As shown in FIG. 1, a bolt 83 mounted on stop 79 engages tube 74 adjusts the tilt position of platform 78. Stop 69 has a similar bolt to adjust the tilt position of platform 67. A roller 81 mounted on the forward outer section of platform 78 functions to engage doors to open the doors with the wheelchair.

Foot rest adjusting screws 84 threaded into a boss 86 secured to the bottom of cross member 37 is used to adjust the angular location of foot rests 28 and 29 relative to seat assembly 27 to accommodate the legs of the person using the wheelchair 20.

Seat assembly 27 has a flat base 87 for supporting a seat cushion. The front of base 87 is secured to pivot members 88 and 89 mounted on opposite ends of rod 59 to pivotally mount base 87 for movement about a transverse horizontal axis. The rear of base 87 is connected to a pair of shock absorbers 91 and 92. As seen in FIG. 3, shock absorber 92 has a body 93 and piston rod 94. A coil spring 96 urges piston rod 94 out of body 93. A pivot pin 97 connects body 93 to base 87. Piston rod 94 is pivotally mounted on a bracket 98 with a pin 99. Bolts 101 secure bracket 98 to side frame member 32. Shock absorber 91 has the same structure as shock absorber 92. As shown in FIG. 2, a bracket 102 secured to side frame member 33 is pivotally connected to the piston rod of shock absorber 91. Returning to FIG. 2, shock absorber 92 is inclined rearwardly and downwardly from the rear of base 87. The normal obtuse angle between horizontal base 87 and the longitudinal axis of shock absorber 92 is about 135 degrees. The angular relationship of shock absorbers 91 and 92 relative to base 87 results in non-linear compression shock absorbing forces applied to seat assembly 27 as the shock absorbers 91 and 92 angularly pivot downward as they are compressed. The forces required to compress the shock absorbers 91 and 92 do not linearly increase. This provides the person with less bumps and shocks which relieves stress and strain on the person and particularly the person's back.

Seat assembly 27 has a pair of side members or plates 103 and 104 pivotally mounted on opposite sides of base 87. A hinge 106 secures the bottom of plate 103 to base 87. Side plate 103 swings outwardly as shown by arrow 107 from an upright vertical position to a down position. The side of seat assembly 27 is open when plate 103 is in the down position. This allows a person to move into seat assembly 27 from the open side. A releaseable lock 108 holds plate 103 in the upright vertical position and allows the plate to move to the down position whereby, the side of seat assembly 27 is open. When lock 108 is released plate 103 and arm rest 109 attached to plate 103 can be pivoted to the down position. Arm rest 109 is a generally rectangular cushion or pad mounted on a longitudinal support 111. A upright plate 112 located adjacent the inside of side plate 103 is secured to support 111. Plate 112 has a pair of vertical slots 113 and 114. Fasteners 116, such as nut and bolt assemblies, extended through the slots 113 and 114 and holes 117 in side plate 103 attach plate 112 to side plate 103. Side plate 103 has a number of holes 117 to allow adjustment of the longitudinal location of arm rest 109. Slots 113 and 114 allow the arm rest 109 to be vertically adjusted.

Figure 6:
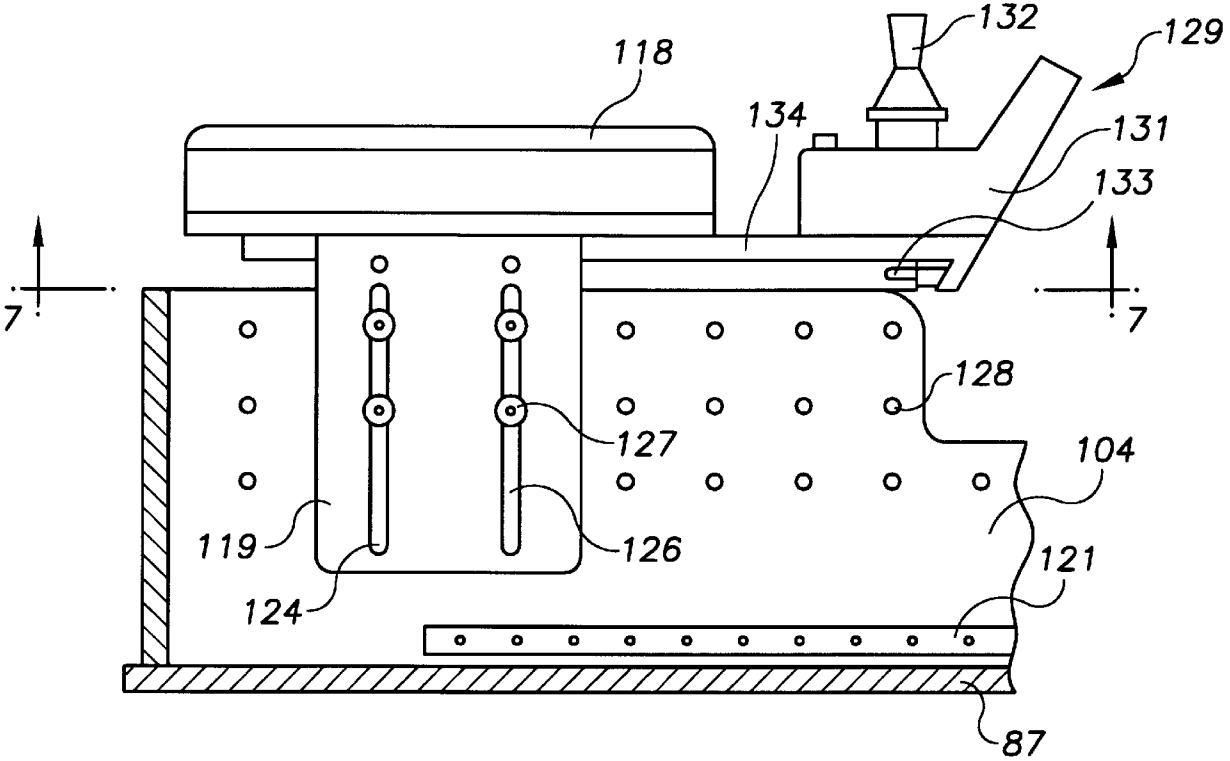
FIG. 6 is a sectional view taken along line 6—6 of FIG. 5.
Figure 7:
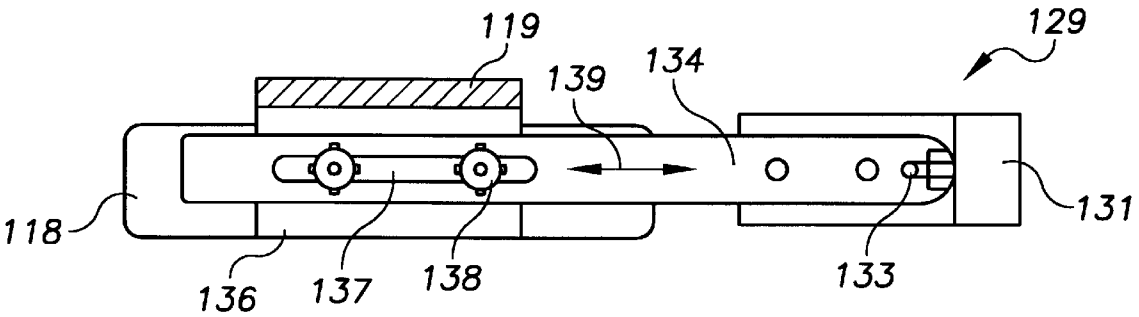
FIG. 7 is a sectional view taken along line 7—7 of FIG. 6.
Figure 9:
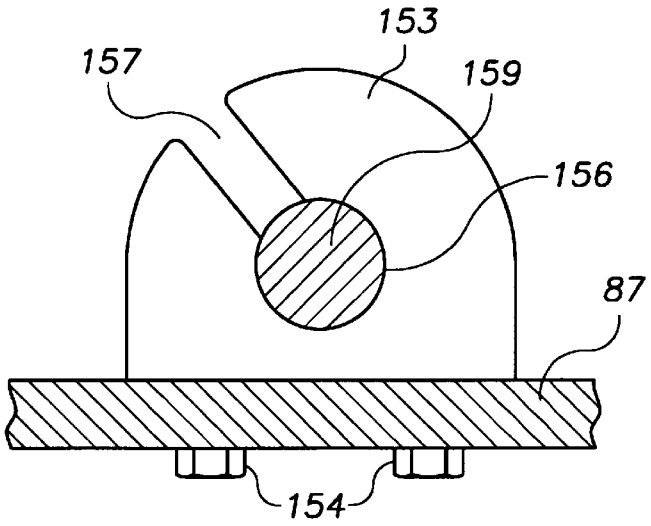
FIG. 9 is an enlarged sectional view taken along line 8—8 of FIG. 8.
Figure 11:
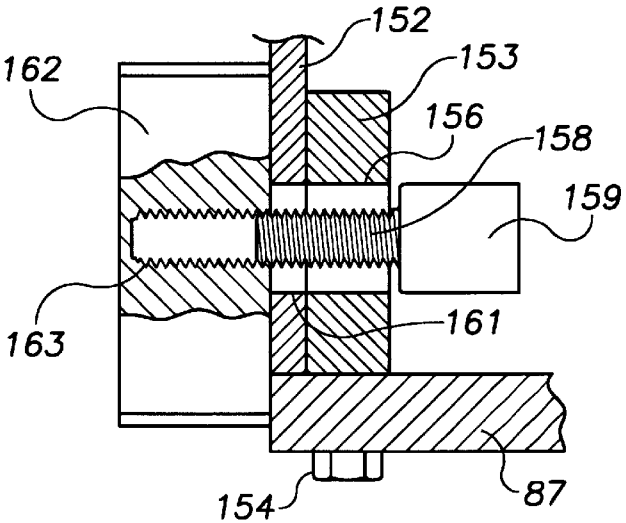
FIG. 11 is a sectional view similar to FIG. 10 showing the lock in the release position.
Figure 8:
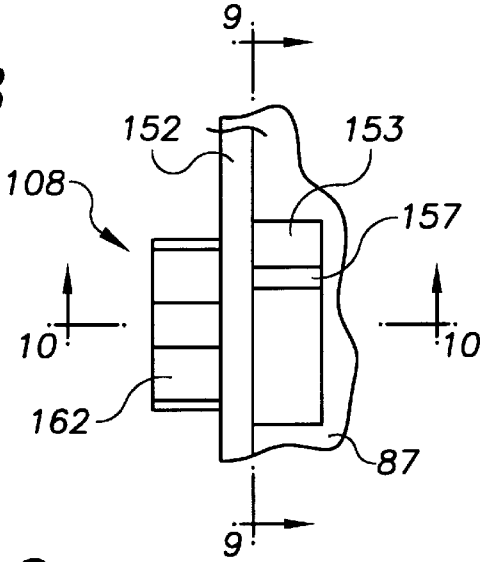
FIG. 8 is a top plan view of the lock for a side plate of the seat assembly.

A second arm rest 118 comprising a generally rectangular cushion or paid is mounted on a plate 119 located adjacent the inside of side plate 104. As shown in FIG. 6, a hinge 121 secures the bottom of side plate 104 to base 87 to allow plate 104 and arm rest 118 to move to a down position as shown by arrow 122. A releaseable lock 123 holds plate 104 and arm rest 118 in an up vertical position. When lock 123 is released plate 104 and arm rest 118 can be moved to the down position thereby opening the right side of sear assembly 27. This provides side or lateral access to seat assembly 27. Plate 119 has a pair of vertical slots 124 and 126 aligned with selected holes 128 in side plate 104. Fasteners 127, such as nut and bolt assemblies, extended through slots 124 and 126 and adjacent holes 128 to secure plate 119 and arm rest 118 in selected vertical and horizontal positions to accommodate the person using the wheelchair.

A wheelchair control unit 129 located in front of arm rest 118 has a casing 131 supporting a joy stick 132 used by the person to control the operation of wheelchair 20. An electrical conductor 133 couples control unit 129 to a controller 178 located within casing 31. Control unit 129 is mounted on a flat bar 134 extended longitudinally under a flange 136 joined to the top of plate 119. Bar 134 has a longitudinal slot 137 for fasteners 138 that secure the bar 134 to flange 136. Bar 134 is longitudinally adjustable, as shown by arrow 139, to provide a location of control unit 129 that is convenient and comfortable for the person using the wheelchair. Bar 134 prevent angular movement of casing 131.

Figure 5:
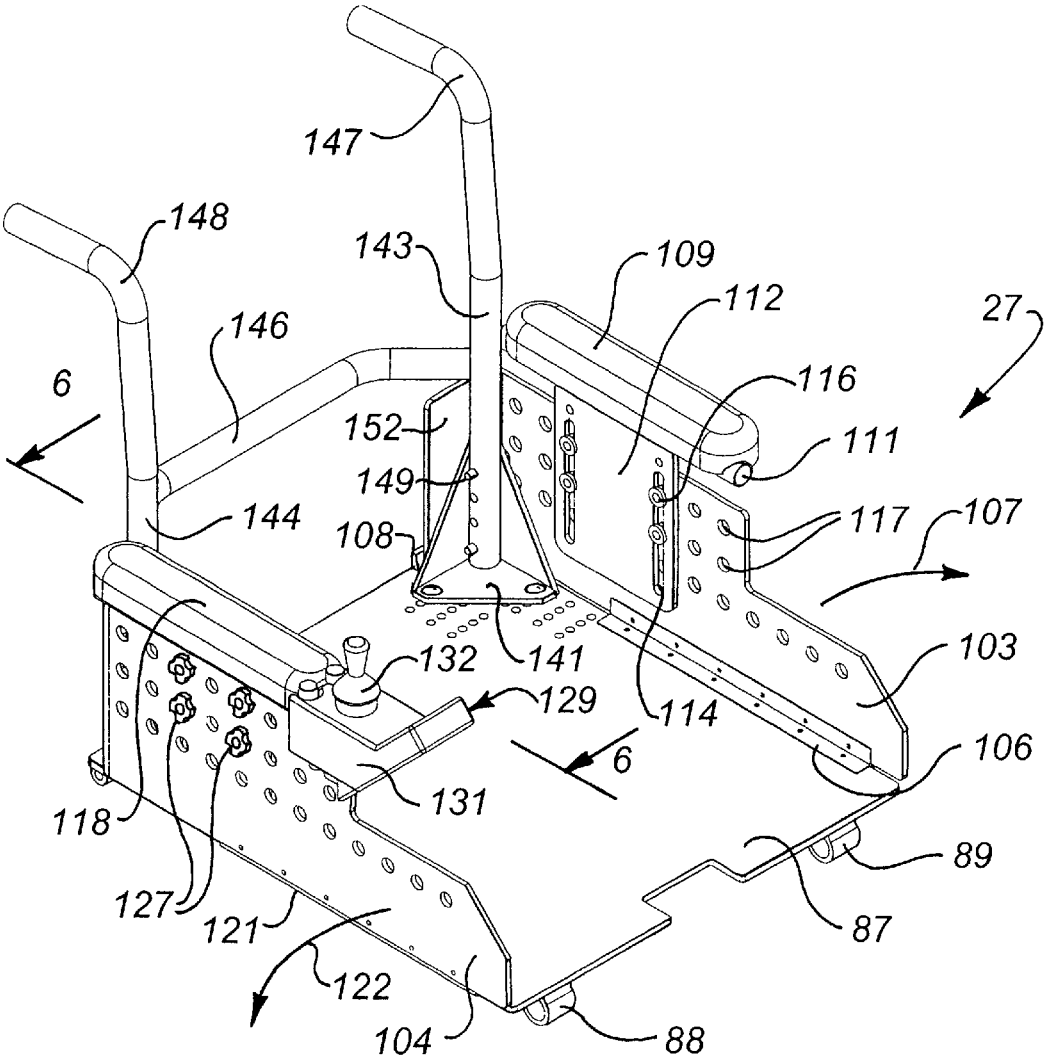
FIG. 5 is a perspective view of the seat assembly of the wheelchair.

Returning to FIGS. 2 and 5, upright right angle supports 141 and 142 are secured to opposite rear corners of base 87. Upright posts 143 and 144 located in the supports 141 and 142 extend upwardly and a joined to rearward turned handles 147 and 148. A cross member 146 extended between posts 143 and 144 has opposite ends secured to posts 143 and 144. Cross member 146 provides support for the back rest cushion of seat assembly 27. Bolts 149 secure post 143 to support 141. Post 144 is secured to support 142 with bolts 151, as shown in FIG. 2.

Figure 10:
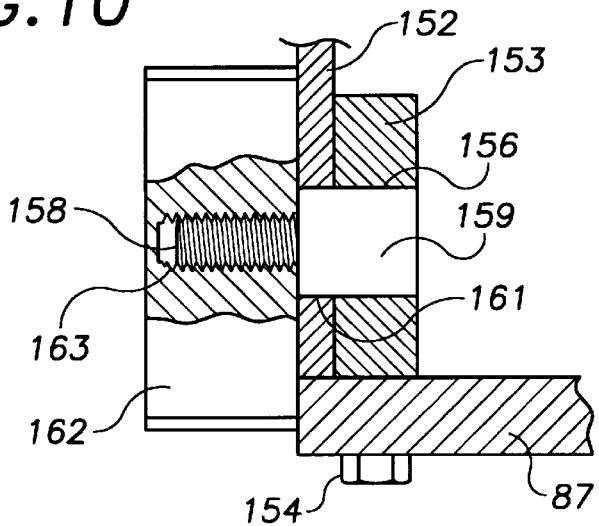
FIG. 10 is an enlarged sectional view taken along line 10—10 of FIG. 9.

Lock 108, shown in FIGS. 8 to 11, holds flange 152 in engagement with base 87 and side plate 103 in engagement with support 141 to retain side plate 103 and arm rest 109 in the upright position and prevent inward movement of plate 103. Lock 108 has a first member 153 secured to base 87 with bolts 154 adjacent support 141. Member 153 has a central hole 156 open to a radial slot 157. A lock bolt 158 having a cylindrical head 159 is aligned with hole 156 and a m .Uhole 161 in flange 162. A knob 162 having a threaded bore 163 is turned on bolt 158 to control the location of head 159 relative to member 153. As shown in FIG. 10, head 159 located in holes 156 and 161 locks flange 152 against base 87 thereby holding side plate 103 and arm rest 109 in an upright position. Knob 162 is turned to move head 159 out of hole 156 to allow flange 152 to pivot away from base 87 whereby the side plate 103 and arm rest 109 move to the down position. Bolt 158 moves through slot 157 during the initial movement of flange 152. Lock 123 has the same structure as lock 108. Other types of releaseable locks can be used to hold side plates 103 and 104 and arm rests attached thereto in upright positions adjacent opposite sides of base 87 in engagement with supports 141 and 142.

Figure 12:
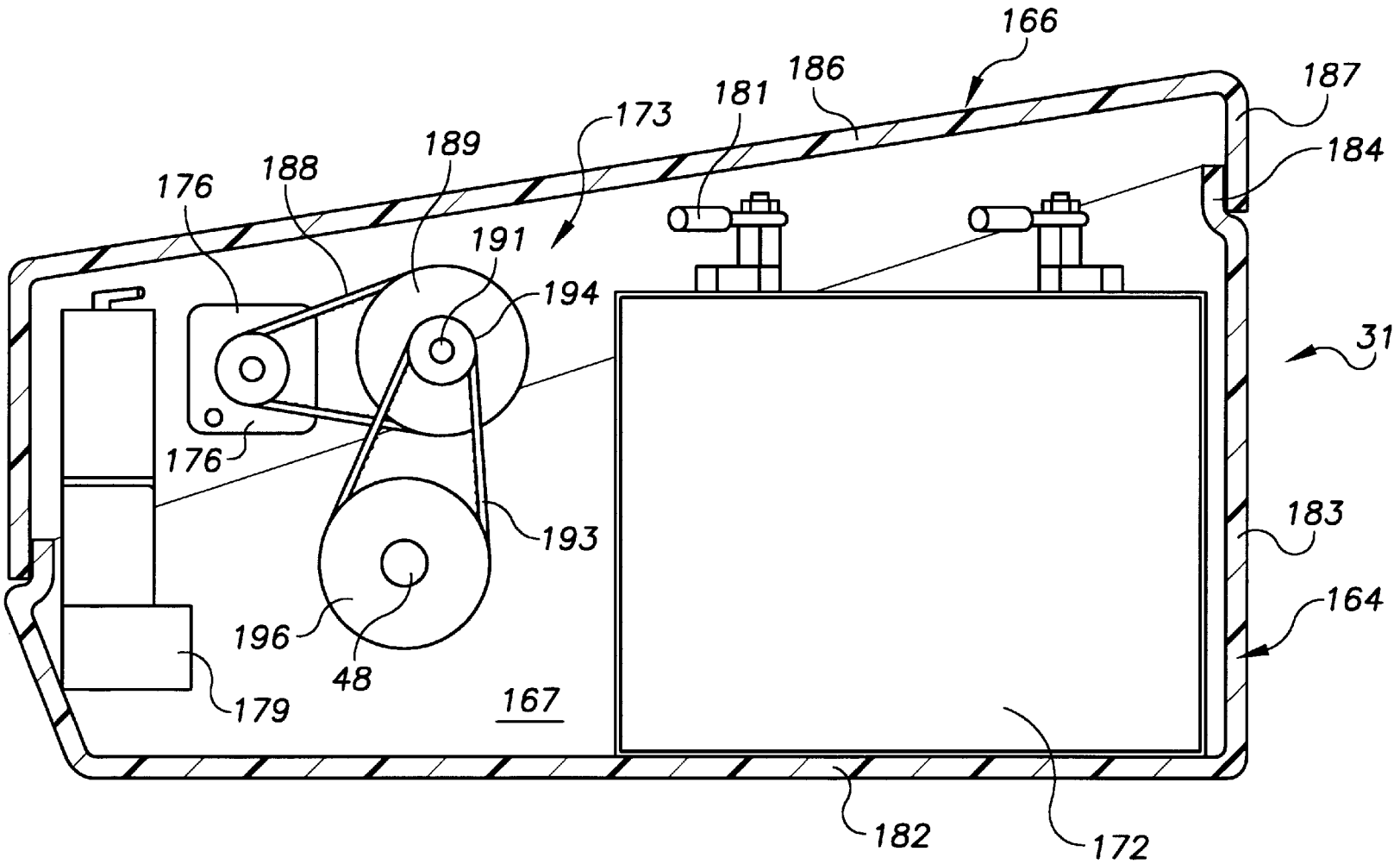
FIG. 12 is a sectional view taken along line 12—12 of FIG. 4.

As shown in FIG. 12, casing 31 is a two piece housing having bottom section or pan 164 with an open top. A cover 166 mounted on pan 164 encloses internal chamber 167. A pair of electric power units 172, such as dc batteries, wheel drives 173 and 174, electric motors 176 and 177, motor controller 178, battery re-charger 179 and electrical cables 181 connecting the motors to the controller and batteries are all located within chamber 167 whereby casing 31 shields all the components from the external environment and enhances the appearance of the wheelchair. Pan 164 has a flat bottom wall 182 joined to an upright side wall 183 having an inwardly stepped lip 184. Cover 166 has a rearwardly inclined top joined to a side wall 187 that fits over lip 184 to close the top of pan 164. A releaseable fastener (not shown) holds cover 166 on pan 164. Pan 164 has outwardly directed flanges 168 on the side walls resting on side frame members 32 and 33 to support casing on the frame. Bolts 171 attach flanges 168 to frame members 32 and 33.

Figure 13:
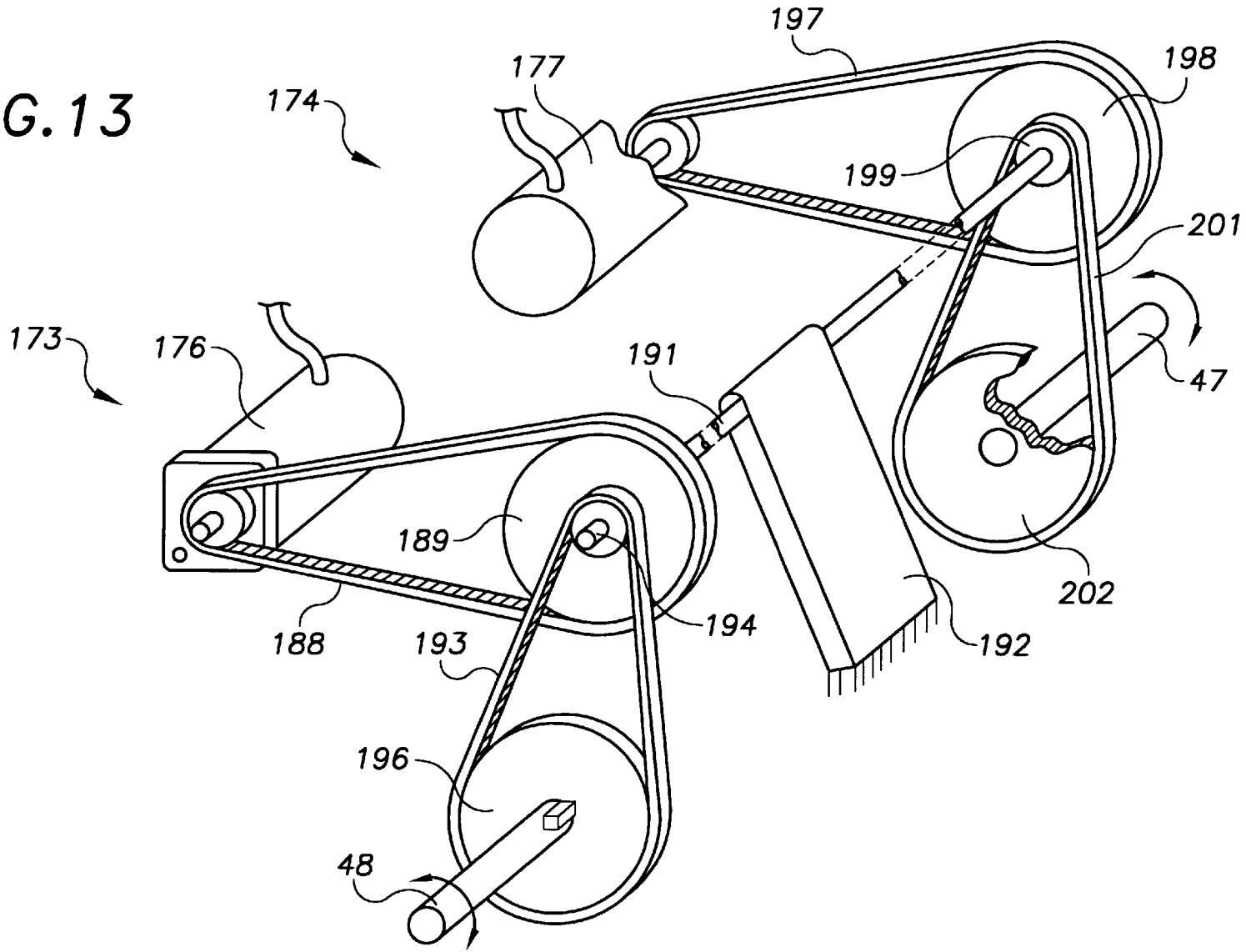
FIG. 13 is a diagrammatic view of the drives for two wheels of the wheelchair.

Wheel drives 173 and 174 are illustrated in FIG. 13 wherein drive 173 transmits power to shaft 48 and drive 174 transmits power to shaft 47. Wheels 22 and 23 mounted on shafts 47 and 48 operate to move and turn wheelchair 20 responsive to manipulation of joy stick 132. Drive 173 has a dc reversible electric motor 176 connected with endless belt 188 to pulley 189. Pulley 189 is journeyed on an axle or cylindrical member 191 extended transversely in chamber 167. One or more arms 192 support axle 191 in casing 31. A small drive pulley 194 connected to pulley 189 drives a second endless belt 193. Belt 193 is trained about pulley 196 which turns wheel shaft 48. Drive 174 has a dc reversible electric motor 177 having the same horsepower and speed as motor 176. An endless belt 197 connects motor 177 with a pulley 198 journaled on axle 191. A small drive pulley 199 connected to pulley 198 accommodates an endless belt 201 trained about pulley 202. Pulley 202 is driveable connected to wheel shaft 47 whereby shaft 47 transmits torque to wheel 22.

In use, joy stick 132 is used by the person seated in seat assembly 27 to control the operation of reversible electric motors 176 and 177 thereby control the movements of wheelchair 20. When joy stick 132 is moved forward motors 176 and 177 simultaneously turn wheels 22 and 23 to drive wheelchair in a straight forward direction. Joy stick 132 also controls the speed of motors 176 and 177 which in turn regulates the speed of wheelchair 20. Maximum speed of wheelchair 20 is achieved by moving joystick 132 to its full forward position. When joystick 132 is pulled back wheelchair 20 moves backwards. Movement of joystick 132 left and right causes wheelchair 20 to turn in the direction of movement of the joystick 132. Joystick 132 returns to its central neutral position which terminates electric power to motors 176 and 177 and applies brakes incorporated in the motors 176 and 177 to prevent inadvertent movement of wheelchair 20.

Figure 14:
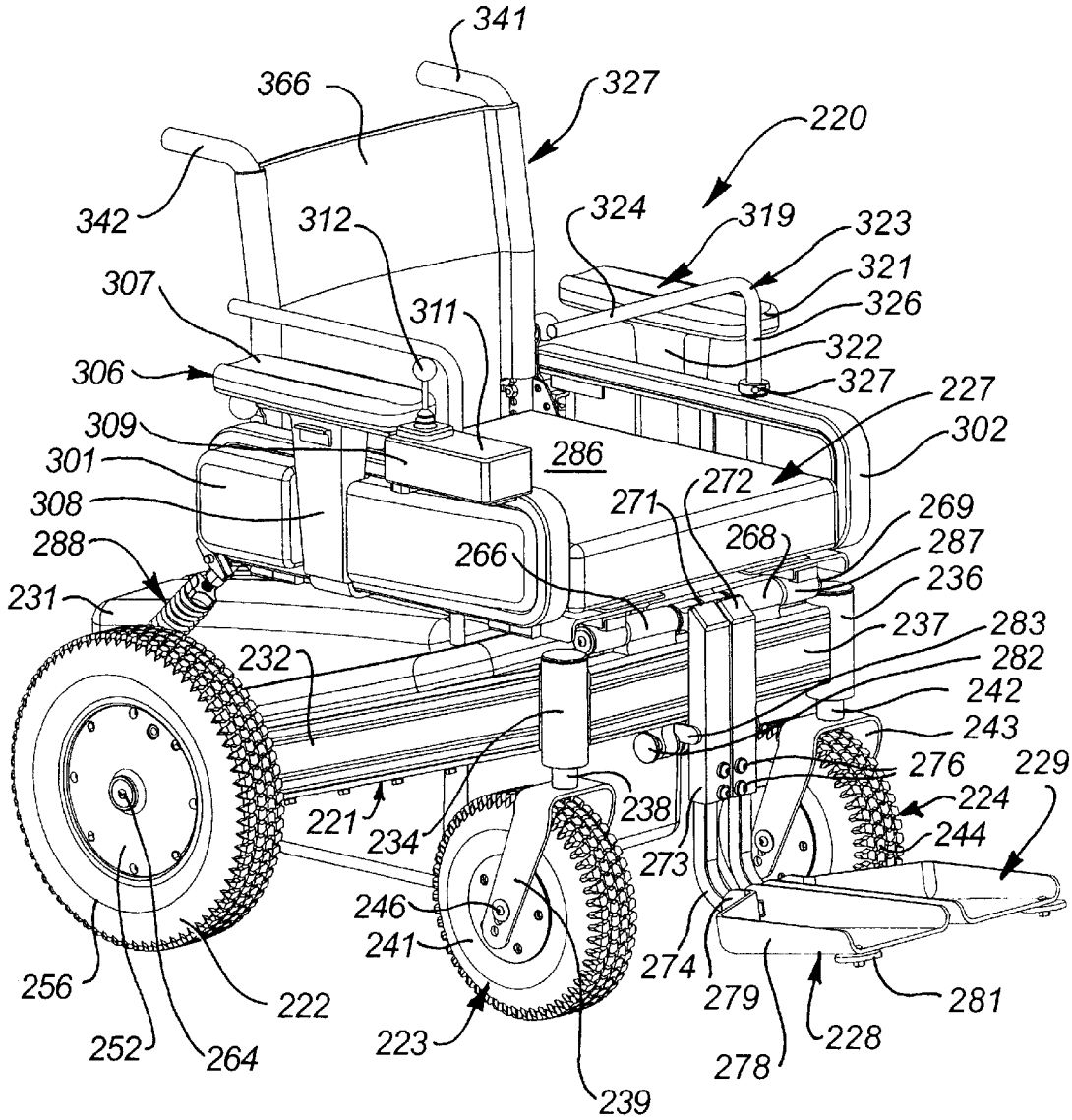
FIG. 14 is a modification of the POWERED WHEELCHAIR of FIG. 1.

Referring to FIG. 14, there is shown a modification of the powered wheelchair, indicated generally at 220. Wheelchair 220 has a frame 221 movable supported on a surface with rear drive wheels 222, and front caster wheels 223 and 224. A seat assembly 227 pivotally mounted on top of frame 221 is adapted to accommodate a person to allow the person to operate the controls of the wheelchair. A pair of foot rests 228 and 229 mounted on the front of frame 221 extends downwardly from the front of seat assembly 227 to support a person's legs and feet. A casing 231 shown as a box-shaped housing mounted on frame 221 encloses the drive motors and power transmissions that connect the motors to drive wheels 222. The batteries, battery charger and motor controls are also located within casing 231. Casing 231 insulates all of the drive components and electric power supply from the external environment, including dust, dirt, water, snow and ice.

Frame 221 has side frame members 232 and 233 having front ends secured to upright tubular members or sleeves 234 and 236. A horizontal cross beam 237 extends between sleeves 234 and 236. The ends of beam 237 are secured to sleeves 234 and 236. Frame members 232 and 233 are rigid metal tubular extrusions inclined downwardly and rearwardly from sleeves 234 and 236 adjacent opposite sides of casing 231.

Caster wheels 223 and 224 are mounted on sleeves 234 and 236 for swinging movement about upright axes to steer wheelchair 220. Caster wheel 223 has an upright post 238 rotatable mounted with bearings within sleeve 234. A yoke 239 straddling the tire 241 is secured to post 238 and axle 246 of the wheel. Caster wheel 224 has an upright post 242 rotatably mounted with bearings within sleeve 236. The lower end of post 242 is secured to a yoke 243 which straddles tire 244. The lower ends of yoke 239 are attached to a horizontal axle 246 of the wheel. Caster wheels 223 and 224 turn about the horizontal axles of the wheels and swing about the upright axes of sleeves 234 and 236 during movement of wheelchair 220.

Figure 15:
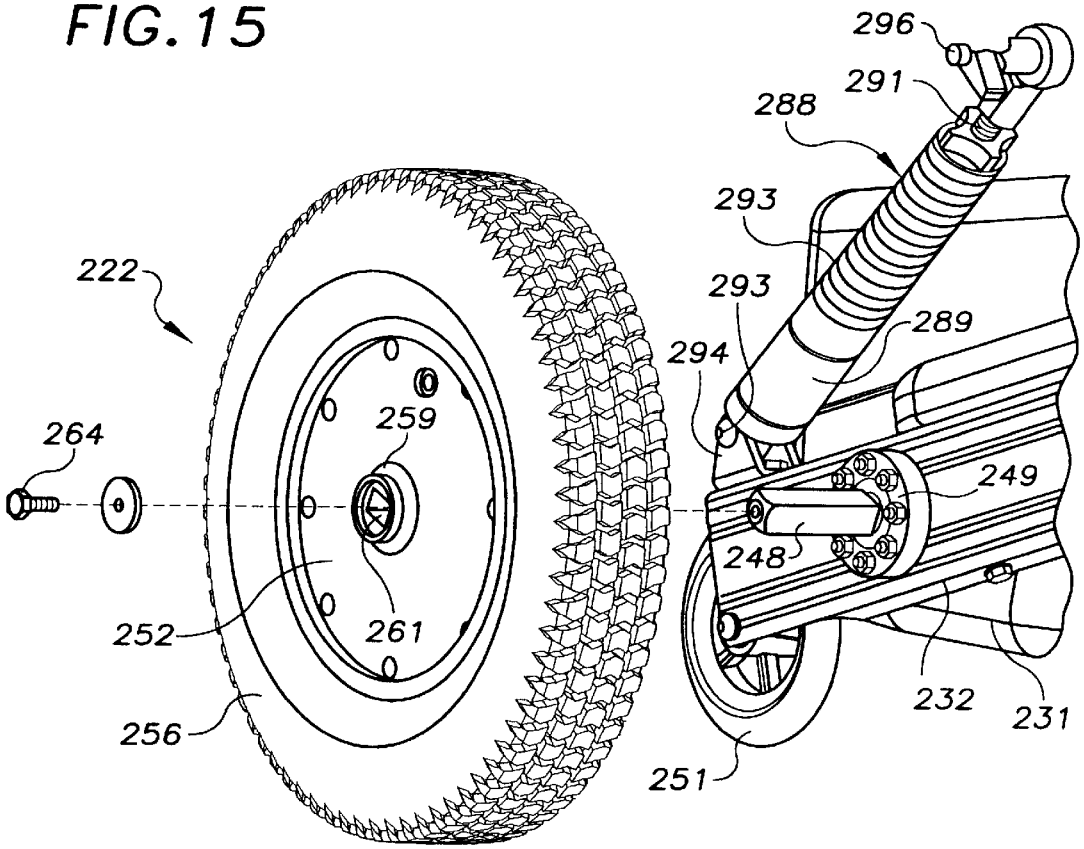
FIG. 15 is an exploded perspective view of a drive wheel and a portion of the side of the frame and drive shaft for the drive wheel.
Figure 16:
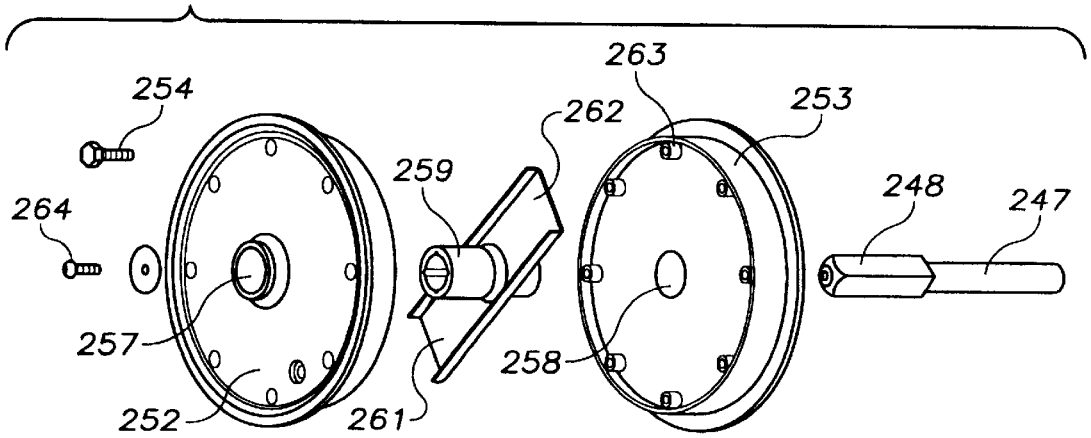
FIG. 16 is an exploded perspective view of the two piece hub of the drive wheel of FIG. 15 and drive shaft.
Figure 17:
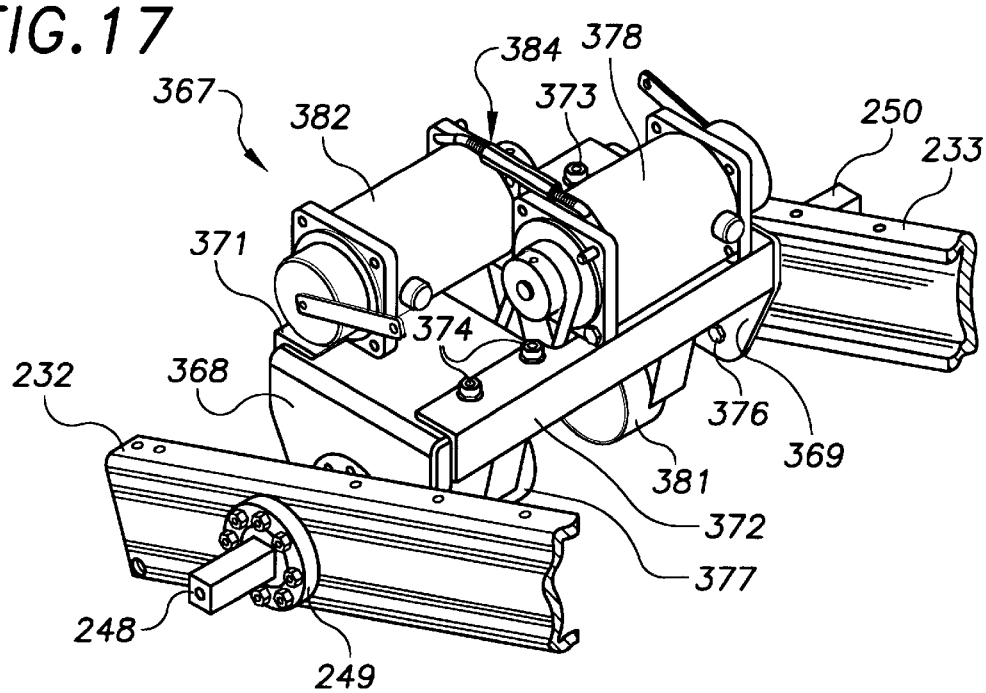
FIG. 17 is a perspective view of electric motors and gear train drive system for the power wheelchair mount on the frame.
Figure 18:
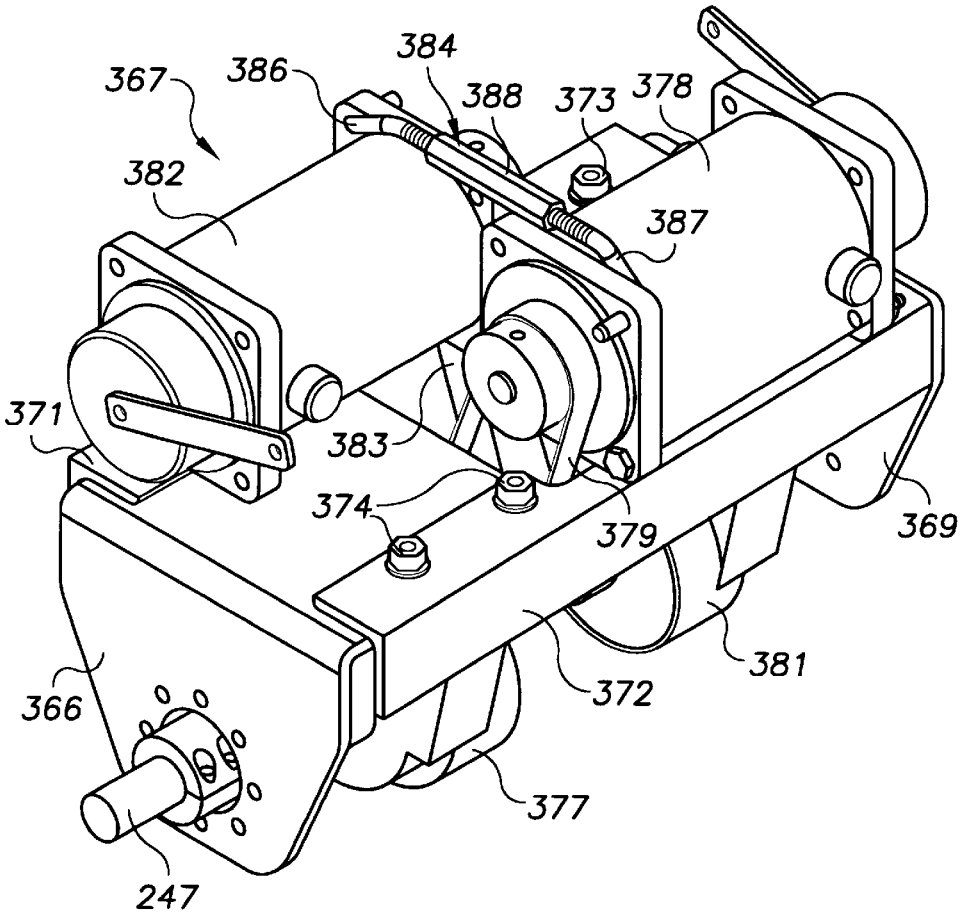
FIG. 18 is a perspective view of drive system shown in FIG. 17.
Figure 19:
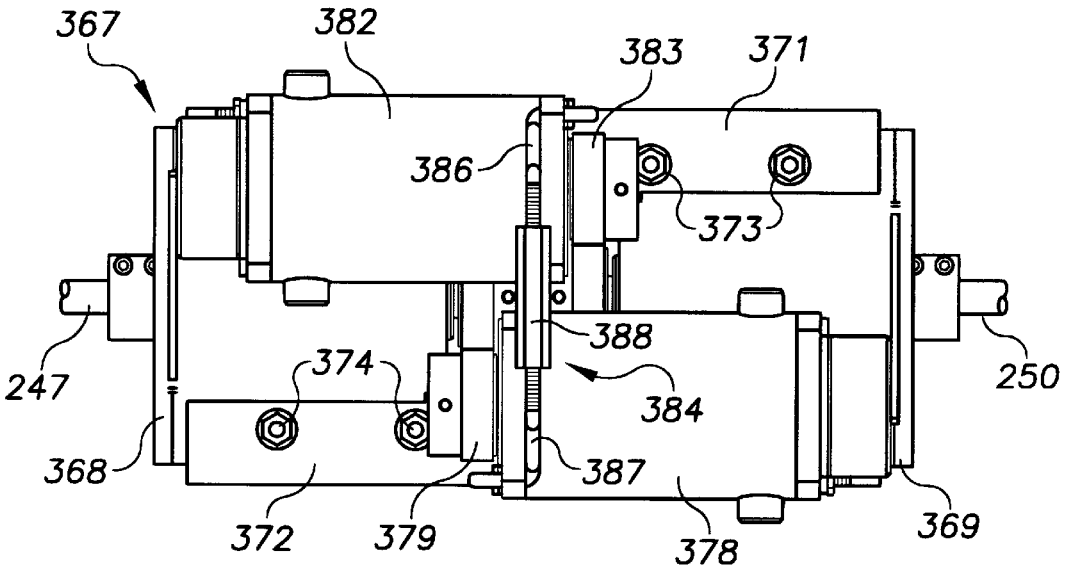
FIG. 19 is a top plan view of the drive system shown in FIG. 17.
Figure 20:
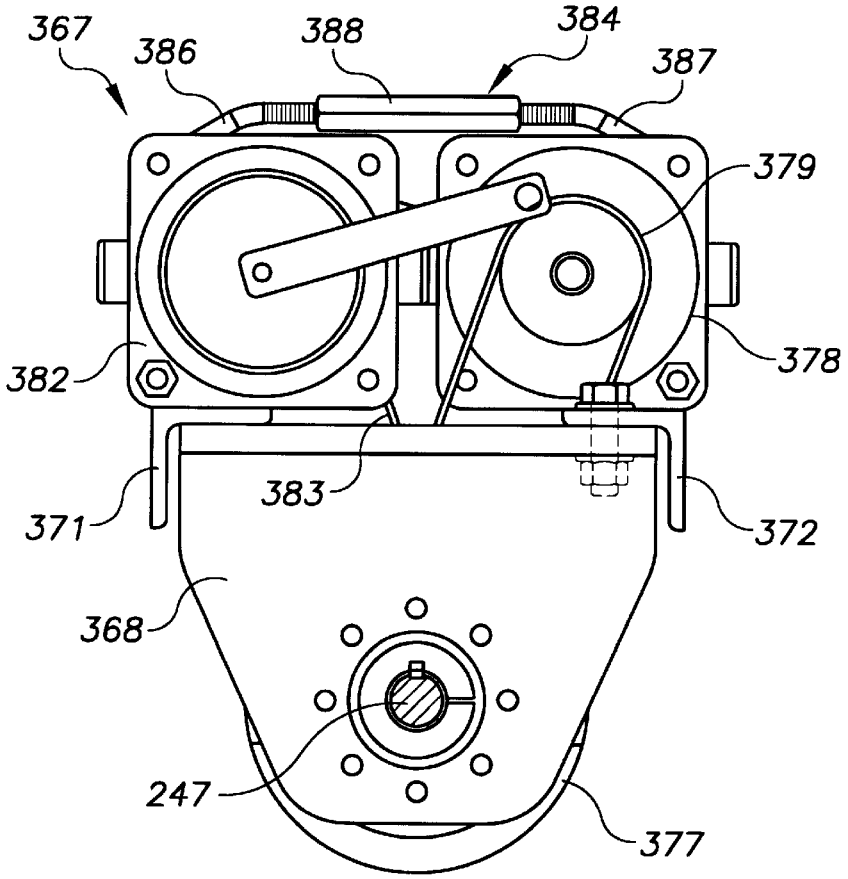
FIG. 20 is an enlarged side elevational view of the drive system shown in FIG. 17.

As shown in FIG. 15, drive wheel 222 is mounted on a drive shaft 247 having a square outer end 248. Bearing 249 rotatably supports drive shaft on side frame 232. The drive wheel on the opposite side of wheelchair 220 is mounted on a separate drive shaft 250 having the same structure as drive shaft 247. Drive wheel 222 has a two piece hub comprising hub members 252 and 253 secured in side-by-side relation with a plurality of bolts 254. A tire 256 is mounted on hub members 252 and 253. Hub member 252 and 253 have central holes 257 and 258 accommodating a sleeve 259 having a square bore 261 for receiving the square end 248 of drive shaft 247. A plate 262 secured to the center of sleeve 259 is sandwiched between hub members 252 and 253. The outer ends of plate 262 located between studs 263 on the insides of hub members 252 and 253 maintain wheel 222 in a fixed drive relation with drive shaft 247.

The rear ends of side frames 232 and 233 rotatably support anti-tip wheels 251. The anti-tip wheels 251 are located rearwardly and below the transverse axles of the drive shafts for drive wheel 222 and the drive wheel on the opposite side of the wheelchair. The wheels 251 prevent wheelchair 220 from tipping backward upon initial forward acceleration.

Returning to FIG. 14, a pair of horizontal tubular members 266 and 268 connected to the top of cross beam 237 accommodates a transverse rod 269. A pair of blocks 271 and 272 rotatable mounted on rod 269 between members 266 and 268 connect foot rests 228 and 229 to rods 269 for pivot movement about a transverse horizontal axis. Foot rest 228 has a first square tube 273 attached to block 271. A second square tube 274 clamps tube 273 onto tube 274. Bolts 276 can be released to allow tube 274 to be vertically adjusted to meet the requirements of the person using wheelchair 220.

A platform 278 is hinged with a bracket 279 to the lower end of tube 274. Bracket 279 has a stop engageable with tube 274 to hold platform 278 in a forward generally horizontal position and allow platform 278 in a forward generally horizontal position and allow platform 278 to be moved up against tube. A bumper roller 281 is rotatably mounted on the outer front corner of platform 278. Roller 281 rides on doors to allow wheelchair 220 to push the doors open. Foot rest 229 has the same structure and function as foot rest 228 for the right leg and foot of the person using the wheelchair.

A foot rest adjuster 282 mounted on cross beam 237 adjusts the angular position of foot rest 228. A similar adjuster on cross beam 237 adjusts the angular position of foot rest 229. Adjuster 282 is a curved arm 283 secured to tube 273. Arm 283 has a number of notches accommodating a releaseable pin to hold the foot rest 228 in a selected angular position.

Figure 21:
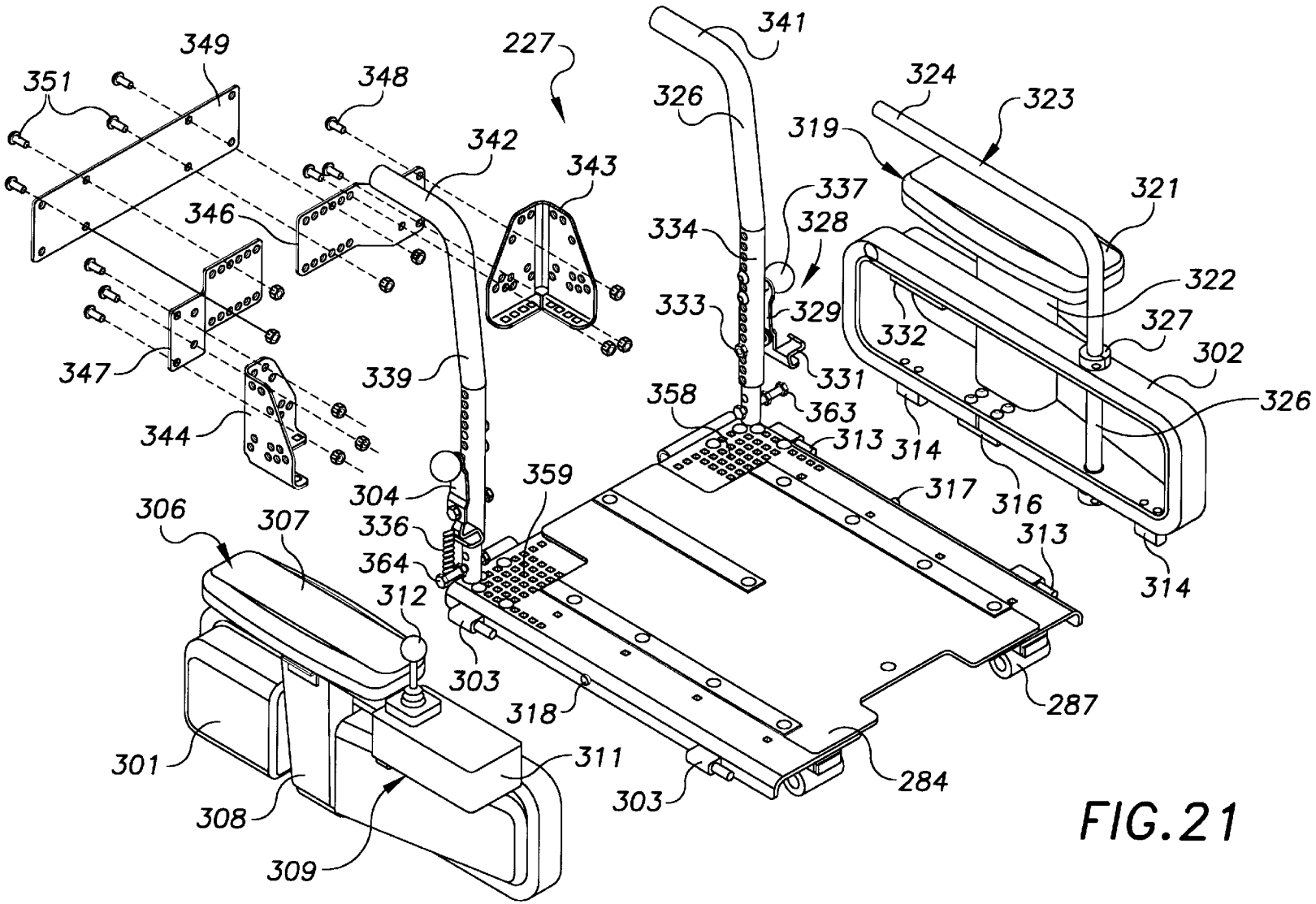
FIG. 21 is an exploded perspective view of the seat assembly of the wheelchair of FIG. 14.

As shown in FIGS. 14 and 21, seat assembly 227 has a flat metal base 284 providing generally horizontal support for a seat cushion 286. The front edge of base 284 is pivotally mounted on opposite ends of rod 269 with sleeves 287. The opposite sides of the rear of base 284 are connected to shock absorbers 288. As seen in FIG. 15, shock absorber 288 has a body 289 and piston rod 291. A coil spring 292 urges piston rod 291 out of body 289. A pivot pin 293 and bracket 294 connects body 289 to side frame 232. Piston rod 291 is pivotally mounted on a base 284 with a pin 296. Shock absorber 288 is inclined rearwardly and downwardly from the rear of base 284. The normal obtuse angle between horizontal base 284 and the longitudinal axis of shock absorber 288 is about 135 degrees. The angular relationship of shock absorber 288 relative to base 284 results in non-linear compression shock absorbing forces applied to seat assembly 227 as the shock absorbers angularly pivot downward as they are compressed. The forces required to compress the shock absorbers do not linearly increase. This provides the person with less bumps and shocks which relieves stress and strain on the person and particularly the person's back.

As shown in FIG. 21, seat assembly 227 has a pair of side members 301 and 302 pivotally mounted on opposite sides of base 284. A hinge 303 secures the bottom of member 301 to base 284. Member 301 swings outwardly from an upright vertical position to a down position. The side of seat assembly 227 is open when member 301 is in the down position. This allows a person to move into seat assembly 227 from the open side. A releaseable lock 304 holds member 301 in the upright vertical position and allows the member to move to the down position whereby, the side of seat assembly 227 is open. When lock 304 is released member 301 and an arm rest 306 attached to member 301 can be pivoted to the down position. Arm rest 306 is a generally rectangular cushion or pad 307 mounted on an upright support 308. Support 308 holds cushion above side member 301. Support 308 is vertically adjustable to allow the elevation of cushion to be changed.

A wheelchair control unit 309 located in front of arm rest 306 has a box shaped casing 311 movably supporting a joy stick 312 used by a person to control the movements of wheelchair 220, Casing 311 encloses a controller electrically coupled to an electric power supply and electric motors that drive the wheels 222. Casing 311 is secured to the top of side member 301. The longitudinal position of casing 311 on side member 301 can be adjusted to accommodate the user of wheelchair 220.

Side member 302 is a longitudinal elongated housing having an inside opening adjacent the side of cushion 286. The inside area of side member 302 is a pocket for objects and items. A hinge 313 comprising a pair of pins that fit into holes in blocks 314 pivotally connect side member 302 to base 284. When side member 302 is in the down position it can be removed from the base 284 by moving it in a forward direction. When side member 302 is in the up position a short bar 316 attached to the middle of the bottom of member 302 engages the head 317 of a bolt thread into base 284. The head 317 prevents side member from moving forward. Hinge 303 has the same structure as hinge 313. A bar and head 318 of a bolt on base 284 retains side member in hinged relation on base 284 when side member 302 is in the up position.

An arm rest 319 has a cushion 321 located above side member 302 and a support 322 mounting rest 319 on side member 302. Support 322 is vertically adjustable to locate arm rest in a location that is convenient and comfortable to the person using the wheelchair.

Side member 302 supports an accessory mounting rod 323 comprising a horizontal arm 324 and a vertical post 326. Vertical post 326 extends through aligned holes in side member 302 to allow arm 324 to swing about an upright axis. A clamp 327 on post 326 is used to adjust the vertical location of arm 324. Arm 324 has a cylindrical shape. Other shapes, such as flat, hexagonal, and semi-circular, can be used for arm 324. The accessories mountable on or carried by arm 324 includes but are not limited to cameras, camcorders, lap trays, fishing poles, back packs, book bags, brief cases, water bottles, mug holders, binoculars, telescopes, and archery bows.

The side member 302 is retained in the up position with a releaseable latch or lock 328. As shown in FIG. 21, latch 328 has a lever 329 with a hook 331 engageable with a bar or keeper 332. Keeper 332 is a bar attached to side member 302 in alignment with hook 331. A pivot bolt 333 mounts lever 329 on a post 334 of the back rest of the wheelchair. A spring attached to lever 329 biases hook in an upward direction. The spring is the same as spring 336 associated with lock 304. The upper end of lever 329 is connected to knob 337 having a pin that fits into a hole in post 334 to hold lever 329 in the lock position. Knob 337 must be pulled away from post 334 to release the pin from post 334 before lever 329 can be pivoted forward to release hook 331 from keeper 332. When hook 331 is out of engagement with keeper 332, side member 302 can be pivoted from the up position to the down position.

Figure 22:
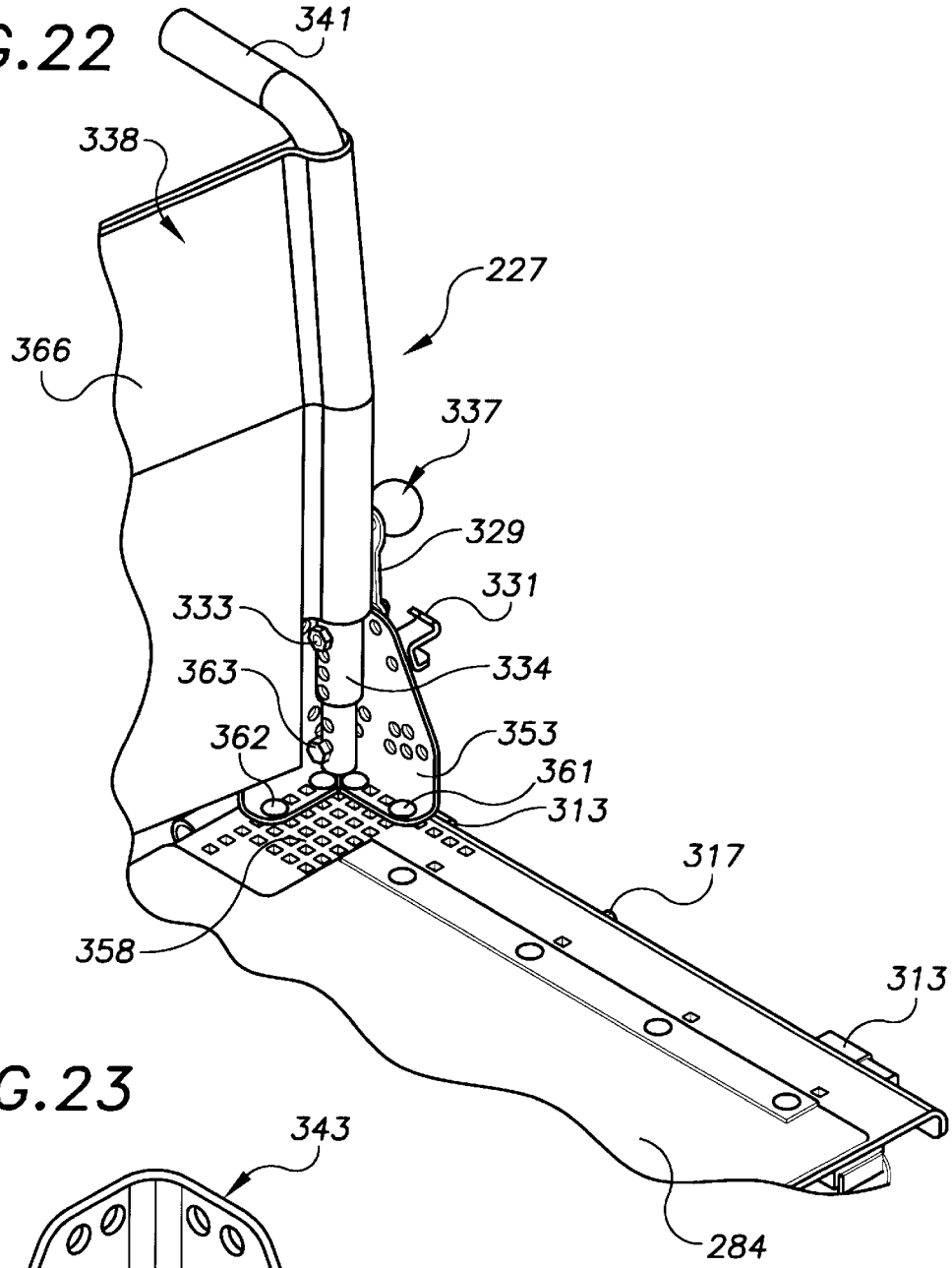
FIG. 22 is a perspective view of a side portion of the seat base and back rest of the wheel chair of FIG. 21.

As shown in FIG. 21 and 22, a back rest 338 extends upwardly from the rear of base 284. Back rest has a pair of upright posts 326 and 339. Each post has telescoping tubular members that permit the elevation of the back rest to be adjusted. The upper ends of the posts 326 and 339 terminate in rearwardly directed handles 341 and 342. Comer members 343 and 344 attached the lower ends of posts 346 and 339 to base 284. A pair of off-set brackets 326 and 347 are connected to corner member 343 and 344 with bolts 348. A flat back plate 349 secured to brackets 346 and 347 with bolts 351 fixes the lateral distance between corner members 343 and 344 and posts 326 and 339. Brackets 346 and 347 have rows of transverse holes which enable lateral width adjustments of posts 326 and 339.

Figure 23:
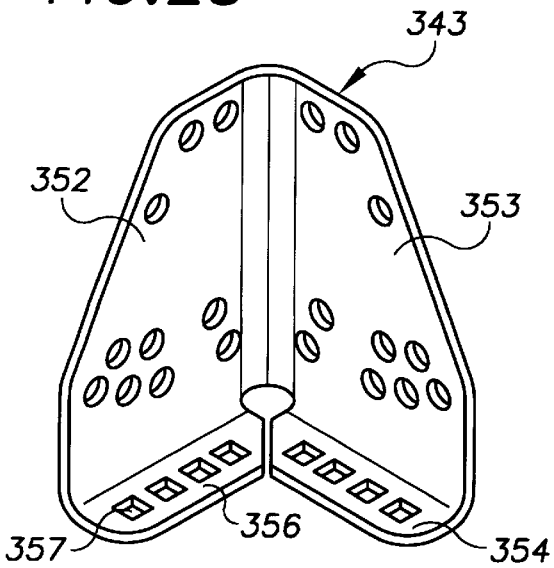
FIG. 23 is a perspective view of a corner support for the back rest shown in FIG. 22.

As shown in FIG. 23, comer member 343 is a right angle support having a lateral portion 352 and a longitudinal portion 353. Flanges 254 and 256 project inwardly from the bottom edges of portions 352 and 353. The portions 352 and 353 and flanges 354 and 356 have holes 357 for bolts to secure corner members 343 and 344 to base 284. As seen in FIG. 21, base 284 has a rectangular patterns of holes 358 and 359 in its opposite rear corners. Bolts 361 and 362 located in holes 358 secure comer member 343 to base 284 in a selected location laterally and longitudinally. Corner member 344 is attached with bolts in selected holes 359 to base 284. The lower ends of posts 326 and 339 are secured to comer members 343 and 344 with bolts 363 and 364. The vertical longitudinal angles of posts 326 and 359 can be adjusted by relocating bolts 363 and 364. This adjusts the upright tilt of back rest 338. A back web 366 looped around posts 326 and 339 is a back support of back rest.

As shown in FIGS. 17 to 20, a drive unit 367 mounted on side frames 232 and 233 transmits torque to the drive shafts 247 and 250 for drive wheels 222. Drive unit 367 has a frame comprising end members 368 and 369 connected with angles cross beams 371 and 372. Bolts 373 and 374 secure beams 371 and 372 to end members 368 and 369. End members 368 and 369 are mounted on side frames 232 and 233 with bolts 376. A first power transmission 377 mounted on end member 368 is drivably connected to drive shaft 247. A reversible D.C. electric motor 378 mounted on cross beam 372 drives power transmission 377 via a belt and pulley drive 379. A second power transmission 381 mounted on end member 369 is driveable connected to drive shaft 250. A reversible D.C. electric motor 382 mounted on cross beam 371 drive power transmission 381 via a belt and pulley drive 383. Power transmissions 377 and 381 are gear boxes having power input shafts driven by electric motors 378 and 382. The gear boxes are hypo-cycloidal back driving speed reducers capable of withstanding high shock overloads. H. Guttinger in U.S. Pat. No. 5,324,240 discloses a gear system that can be used in drive unit 367. Other types of gear systems and chain drives can be used to transmit power from electric motors 378 and 382 to drive shafts 247 and 250.

A linkage 384 connected to adjacent end plates of motors 378 and 382 currently tensions the belt of belt and pulley drives 379 and 383. Linkage 384 comprises a first hook rod 386, a second hook rod 387 and an elongated nut 388. Rods 386 and 387 have turned or hook ends extended through holes in the end plates of motors 378 and 382 and threaded ends accommodated by nut 388. Nut 388 is turned to move motor end plates apart to adjust the tension of the belts of belt and pulley drives 379 and 383. When belt tension is adjusted bolts 373 and 374 are secured to end members 368 and 369. Electric motors 378 and 382 can be pivotally mounted onbeams371 and 372 for movement about parallel transverse axes. Linkage 384 operates to pivot motors 378 and 383 away from each other thereby tensioning the belt of drives 379 and 383. Linkage 384 holds the motors 378 and 383 in selected location to maintain the tension of the belts. Other types of belt tensioning devices can be used to maintain the belts in efficient operating tension.

Drive mechanism 367 is located within casing 231 along with an electric power source comprising a pair of D.C. batteries, a motor controller, a battery re-charger, and electrical cables connecting motors 378 and 382 to the controller and batteries. Casing 231 shields all the components from the external environment and enhances the appearance of wheelchair 220. Casing 231 is a two piece structure comprising a pan and cover as shown in FIG. 12. The controls of control unit 309 are connected with a cable to the motor controller so that movement of joy stick 312 controls the operation of reversible electric motors thereby controlling the movements of wheelchair 220. When joy stick 312 is moved forward motors 378 and 382 simultaneously turn drive wheels 222 to drive wheelchair in a straight forward direction. Joy stick 312 also controls the speed of motors 378 and 382 which in turn regulates the speed of wheelchair 220. Maximum speed of wheelchair 220 is achieved by moving joystick 312 to its full forward position. When joystick 312 is pulled back wheelchair 220 moves backwards. Movement of joystick 312 left and right causes wheelchair 220 to turn in the direction of movement of the joystick 312. Joystick 312 automatically returns to its central neutral position which terminates electric power to motors 378 and 382 and applied brakes incorporated in the motors 378 and 382 to prevent inadvertent movement of wheelchair 220.

The invention has been described with reference to the preferred embodiments of the powered wheelchair. Modifications, changes of materials, and alternations will occur to others upon a reading and understanding of this specification. If is intended to include all such modifications and alternations in so far as they come within the scope of the appended claims or the equivalents thereof

What is claimed is:

1. A wheelchair for accommodating a person comprising: a frame, drive shafts rotatably mounted on the frame, drive wheels secured to the shafts, at least one caster wheel mounted on the frame, said drive and caster wheels supporting the wheelchair on a surface, a seat assembly mounted on the frame, said seat assembly having a generally flat normally horizontal base with front and rear portions and opposite longitudinal sides, upright side members located adjacent the opposite sides of the base, means connecting the upright side members to the opposite sides of the base to allow the upright side members to be moved from upright positions to generally down positions, lock means to selectively hold the upright side members in the upright positions, said lock means being releasable to allow the side members to move to the generally down positions, arm rests located adjacent upright side members, means mounting the arm rests on the upright side members in selected vertical positions, transverse pivot means pivotally mounting the front portion of the base to the frame for pivotal movement about a transverse axis, said pivot means comprising a transverse rod, means mounting the rod on the frame adjacent the front portion of the base, means pivotally mounting the front portion of the base to the frame for pivotal movement of the base about the horizontal axis, foot rest means extended downwardly from the front of the base of the seat assembly for supporting the legs and feet of a person located on the seat assembly, means connected to the foot rest means pivotally mounting the foot rest means on the rod for movement about the horizontal axis, means connected to the foot rest means and frame for holding the foot rest means in a selected position, shock absorber means including coil springs pivotally connected to the rear portion of the base and the frame to cushion the seat assembly on the frame, said shock absorbers being inclined downwardly and rearwardly from the rear portion of the base whereby the coil springs of the shock absorber means have non-linear shock absorbing characteristics to reduce shock forces to a person on the seat assembly, power means connected to the drive shafts operable to rotate the drive shafts thereby rotating the drive wheels to move the wheelchair on a surface, said power means includes an electric supply, a pair of reversible electric motors connected to the electric power supply, a first power transmission means drivably connecting one electric motor to one drive shaft to transmit power to the one drive shaft thereby rotating one drive wheel, and a second power transmission means drivably connecting the other electric motor to the other drive shaft to transmit power to the other drive shaft thereby rotating the other drive wheel, case means mounted on the frame below the seat assembly having an enclosed internal chamber, said casing means comprising a housing having an open top, a bottom wall and side walls joined to the bottom wall surrounding the internal chamber and a cover mounted on the side walls closing the open top of the housing, means mounting the housing on the frame, said electric power supply, electric motors, and first and second power transmission means being located in the chamber to protect the electric power supply electric motors, and first and second power transmission means from the external environment, and controll means mounted on one of the arm rest connected to the power means useable by the person to control the operation of the power means thereby controlling the movement of the wheelchair.

2. The wheelchair of claim 1 wherein: the means connecting the upright members to the base are hinges secured to the upright members and base.

3. The wheelchair of claim 1 including: upright supports secured to the base adjacent the upright members, one of the upright members when in the upright position being engageable with one of the supports, the other upright member when in the up position being engageable with the other of the supports.

4. The wheelchair of claim 1 wherein: the upright members have inwardly directed flanges, said means to lock the upright members in upright position comprising a pair of releaseable locks.

5. A wheelchair for accommodating a person comprising: a frame having a transverse front portion and a rear portion, drive shafts rotatably mounted on the rear portion of the frame, drive wheels secured to the rear portion of the frame, at least one caster wheel mounted on the front portion of the frame, said drive and caster wheels being operable to support the wheelchair on a surface and allow the wheelchair to move relative to the surface, a seat assembly for accommodating a person, said seat assembly including a base having a front portion and a rear portion, transverse pivot means pivotally mounting the front portion of the base to the front portion of the frame for pivotal movement about a transverse horizontal axis, foot rest means extended downwardly from the front portion of the base of the seat assembly for supporting the legs and feet of a person located on the seat assembly, means mounting the foot rest means on the transverse pivot means, shock absorbers having coil springs pivotally connected to the rear portion of the base and the rear portion of the frame, said shock absorbers being inclined downwardly and rearwardly from the rear portion of the frame, said shock absorbers being inclined downwardly and rearwardly from the rear portion of the base whereby the coil springs of the shock absorbers have non-linear compression characteristics to cushion the seat assembly on the frame, power means mounted on the frame and connected to the drive shafts operable to rotate the drive shafts thereby rotating the drive wheels to move the wheelchair on a surface, and control means mounted on the seat assembly and connected to the power means useable by a person to control the operation of the power means thereby controlling the movement of the wheelchair.

6. The wheelchair of claim 5 wherein: said pivot means comprises a transverse rod mounted on the frame adjacent the front of the seat assembly, and means pivotally mounting the base on the rod, and said foot rest means comprises a pair of foot rests extended downwardly from the front of the seat assembly, and means pivotally mounting the foot rests on the rod.

7. The wheelchair of claim 6 wherein: each foot rest has a platform for supporting a foot of person seated in the seat assembly, arm means connected to the means pivotally mounting the foot rests on the rod, and means pivotally connecting the platform to the arm means for selective movement between a generally horizontal position and a upright position adjacent the arm means.

8. A wheelchair for accommodating a person comprising: a frame having a front portion and a rear portion, drive shafts rotatably mounted on the rear portion of the frame, drive wheels secured to the shafts, caster wheels mounted on the front portion of the frame, said drive and caster wheels supporting the wheelchair on a surface, a seat assembly mounted on the frame, said seat assembly having a base, said base having opposite sides, a front portion and a rear portion, a transverse rod having a horizontal transverse axis mounted on the frame adjacent the front portion of the base, means pivotally mounting the front portion of the base on the rod to allow the sent assembly to pivot on the rod about the transverse axis of the rod, foot rest means extended downwardly from the front portion of the base for supporting the legs and feet of a person located on the seat assembly, means mounting the foot rest means on the rod, shock absorber biasing means having compression springs connected to the frame and rear portion of the base for controlling pivotal movements of the seat assembly, said shock absorber biasing means being inclined downwardly and rearwardly from the rear portion of the base whereby the shock absorber biasing means having non-linear compression characteristics to cushion the seat assembly on the frame, upright members located adjacent the opposite sides of the base, means connecting the upright members to the base for movement from upright positions to down positions, means to selectively lock the members in the upright positions and allow the upright members to move to the down positions, arm rests mounted on the upright members, power means mounted on the frame below the seat assembly and connected to the drive shafts operable to rotate the drive shafts thereby rotating the drive shafts to move the wheelchair on the surface, and control means mounted on the seat assembly operably connected to the power means useable by the person to control the operation of the power means thereby controlling the movement of the wheelchair.

9. The wheelchair of claim 8 including: upright supports secured to opposite portions of the base, upright posts connected to the supports, and a handle attached to each of the posts.

10. The wheelchair of claim 8 wherein: the means connecting the upright members to the base are hinges secured to the members and base.

11. The wheelchair of claim 8 including: upright supports secured to the base adjacent the upright members, one of the upright members when in the upright position being engageable with one of the supports, the other upright member when in the up position being engageable with the other of the supports.

12. The wheelchair of claim 8 wherein: the upright members have inwardly directed flanges, said means to lock the upright members in upright position comprising a pair of releaseable locks.

13. The wheelchair of claim 8 wherein: said foot rest means includes a pair of foot rests extended downwardly from the front of the seat assembly, and means pivotally mounting the foot rests on the rod.

14. The wheelchair of claim 13 wherein: each foot rest has a platform for supporting a foot of person seated in the seat assembly, arm means connected to the means pivotally mounting the foot rests on the rod, and means pivotally connecting the platform to the arm means for selective movement between a generally horizontal position and a upright position adjacent the arm means.

15. The wheelchair of claim 8 wherein: the power means includes an electric power supply, a drive for each drive shaft, said drive comprising a reversible electric motor connected to the electric power supply, a power transmission means operable to apply torque to the drive shaft, and a belt and pulley drive connecting the power transmission means to the electric motor whereby the electric motor applies torque to a wheel to move the wheelchair.

* * * * *